US011215345B2

(12) United States Patent
Maghnagi et al.

(10) Patent No.: US 11,215,345 B2
(45) Date of Patent: Jan. 4, 2022

(54) MOTORIZED RECESSED SPOTLIGHT

(71) Applicant: FORMA LIGHTING ITALIA S.R.L., Milan (IT)

(72) Inventors: Lawrence Maghnagi, Milan (IT); Angelino Tacchi, Milan (IT)

(73) Assignee: FORMA LIGHTING ITALIA S.R.L., Milan (IT)

( * ) Notice: Subject to any disclaimer, the term of this patent is extended or adjusted under 35 U.S.C. 154(b) by 0 days.

(21) Appl. No.: 16/979,574

(22) PCT Filed: Mar. 12, 2019

(86) PCT No.: PCT/IB2019/051973
§ 371 (c)(1),
(2) Date: Sep. 10, 2020

(87) PCT Pub. No.: WO2019/175751
PCT Pub. Date: Sep. 19, 2019

(65) Prior Publication Data

US 2021/0003271 A1 Jan. 7, 2021

(30) Foreign Application Priority Data

Mar. 14, 2018 (IT) ..... 102018000003531

(51) Int. Cl.
*F21V 21/15* (2006.01)
*F21S 8/02* (2006.01)
*F21V 14/02* (2006.01)

(52) U.S. Cl.
CPC ..... *F21V 21/15* (2013.01); *F21S 8/026* (2013.01); *F21V 14/02* (2013.01)

(58) Field of Classification Search
CPC ..... F21V 21/04; F21V 21/15; F21V 21/30; F21S 8/02
See application file for complete search history.

(56) References Cited

U.S. PATENT DOCUMENTS 2,362,110 A * 11/1944 Meyerhoefer ..... B60Q 1/05 362/361
2,401,390 A * 6/1946 Unger ..... B64D 47/04 362/347
2,654,830 A * 10/1953 Runge ..... F21V 21/30 362/269
3,778,609 A * 12/1973 Liberman ..... F21V 21/30 362/364
5,145,249 A * 9/1992 Bruckner ..... F21V 17/02 362/364

(Continued)

FOREIGN PATENT DOCUMENTS

WO WO-2018104341 A1 * 6/2018 ..... F21V 21/30

*Primary Examiner* — Alexander K Garlen

(57) ABSTRACT

A recessed spotlight includes a frame, a hemispherical cap connected to the frame and arranged to rotate relative to the frame about at least one longitudinal axis of rotation of the cap. The recessed spotlight also includes a means for emitting a light beam that is arranged inside and is integral with the cap, and at least one device for rotationally driving the cap about the longitudinal axis. The at least one device includes a means for mounting the cap, which is arranged along a bottom, outer, annular edge of the cap and is designed to rotate about the longitudinal axis. The mounting means is arranged tangentially on the annular edge of the cap.

22 Claims, 10 Drawing Sheets

(56) References Cited

U.S. PATENT DOCUMENTS

| | | | | |
|---|---|---|---|---|
| 5,289,358 | A * | 2/1994 | Halemeier | A47B 97/00<br>362/269 |
| 5,609,408 | A * | 3/1997 | Targetti | F21S 8/02<br>362/523 |
| 5,803,585 | A * | 9/1998 | Littman | F21S 8/028<br>362/147 |
| 8,215,805 | B2 * | 7/2012 | Cogliano | F21V 21/04<br>362/366 |
| 2010/0103685 | A1 * | 4/2010 | Austin | F21V 21/30<br>362/366 |

* cited by examiner

PRIOR ART

MOTORIZED RECESSED SPOTLIGHT

CROSS-REFERENCE TO RELATED APPLICATIONS

The present application is a national stage entry of International Patent Application No. PCT/162019/051973, filed on Mar. 12, 2019, which claims priority to Italian Patent Application No. 102018000003531, filed on Mar. 14, 2018.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO A SEQUENCE LISTING

Not applicable.

STATEMENT REGARDING PRIOR DISCLOSURES BY THE INVENTOR OR A JOINT INVENTOR

Not applicable.

BACKGROUND OF THE INVENTION

Field of the Invention

The present invention relates to a motorized recessed spotlight.

BRIEF DESCRIPTION OF RELATED ART

Various types of ceiling-mounted, motorized, recessed spotlights which can be operated by means of a remote control are known.

This feature is particularly useful in commercial premises, museums or hospitals, where frequent variations of the surroundings and/or lighting conditions require adaptation of the direction of the light beam.

A drawback of the lighting produced by means of known recessed spotlights consists in the limited angle of emission of the light beam; as shown in FIG. 1A, when the beam is directed more horizontally, it is intercepted by the mounting frame of the spotlight, this being unacceptable for achieving a high-quality lighting effect, since it reduces the possibility of varying the lighting of objects arranged, for example, on walls situated laterally with respect to the ceiling in which the spotlight is recess-mounted. The technical problem which is posed, therefore, is that of providing a ceiling-mounted recessed spotlight which is able to allow orientation of the light beam through a wide angle and without obstacles.

SUMMARY OF THE INVENTION

In connection with this problem it is also desirable that a recessed spotlight having the aforementioned feature should not be dissimilar from the other recessed spotlights when the light is directed vertically, i.e. it is preferable that any mechanism provided for orientation of the light beam should not be visible to the user.

It is also required that this spotlight should have small dimensions, be easy and inexpensive to produce and assemble and be able to be easily installed at any user location using normal standardized connection means. These results are obtained according to the present invention by a spotlight according to the claims.

BRIEF DESCRIPTION OF THE SEVERAL VIEWS OF THE DRAWINGS

Further details may be obtained from the following description of a non-limiting example of embodiment of the subject of the present invention provided with reference to the attached drawings in which.

For greater clarity, the details which are conventional per se, such as electrical wiring and fixing elements, have been excluded from all the figures.

DETAILED DESCRIPTION OF THE INVENTION

Figure 1A:
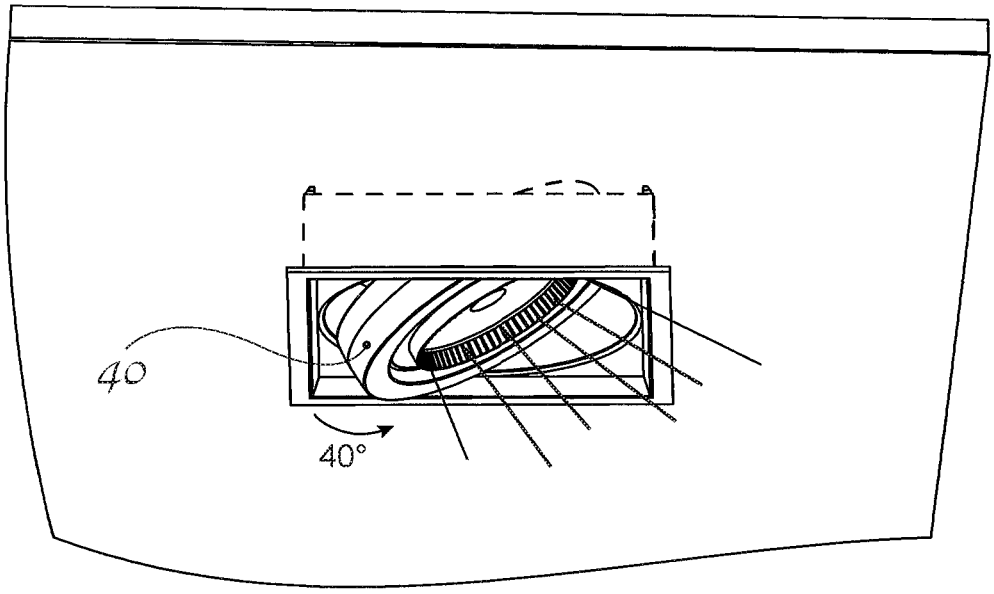
FIG. 1A: is a perspective view a ceiling-mounted recessed spotlight according to the prior art.
Figure 1B:
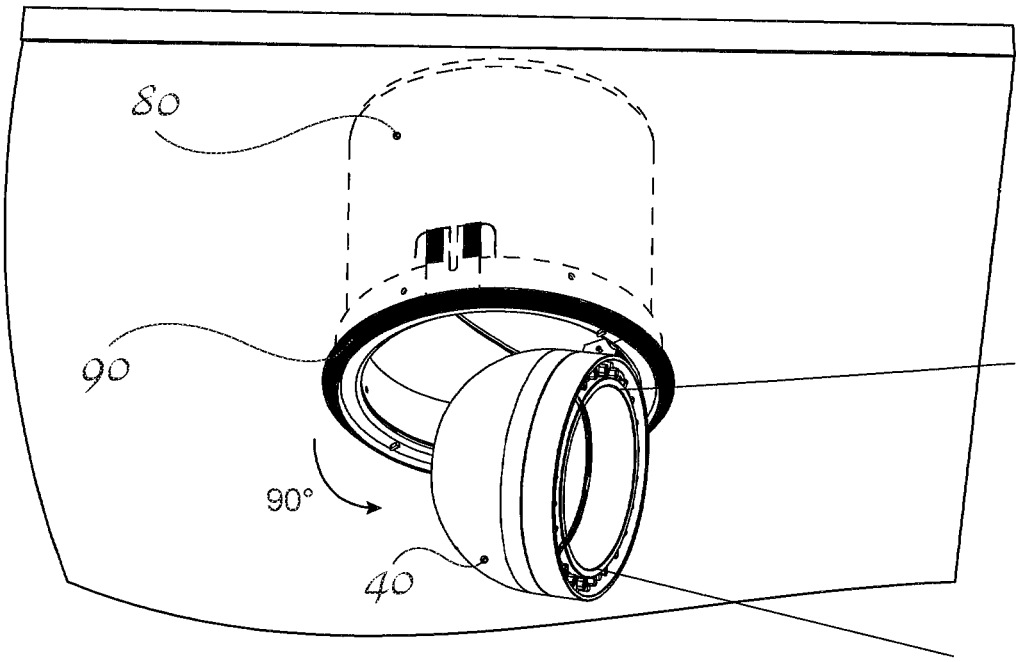
FIG. 1B: is a view, similar to that of FIG. 1A, of a ceiling-mounted recessed spotlight according to the invention with the cap rotated outwards through 90°.
Figure 2:
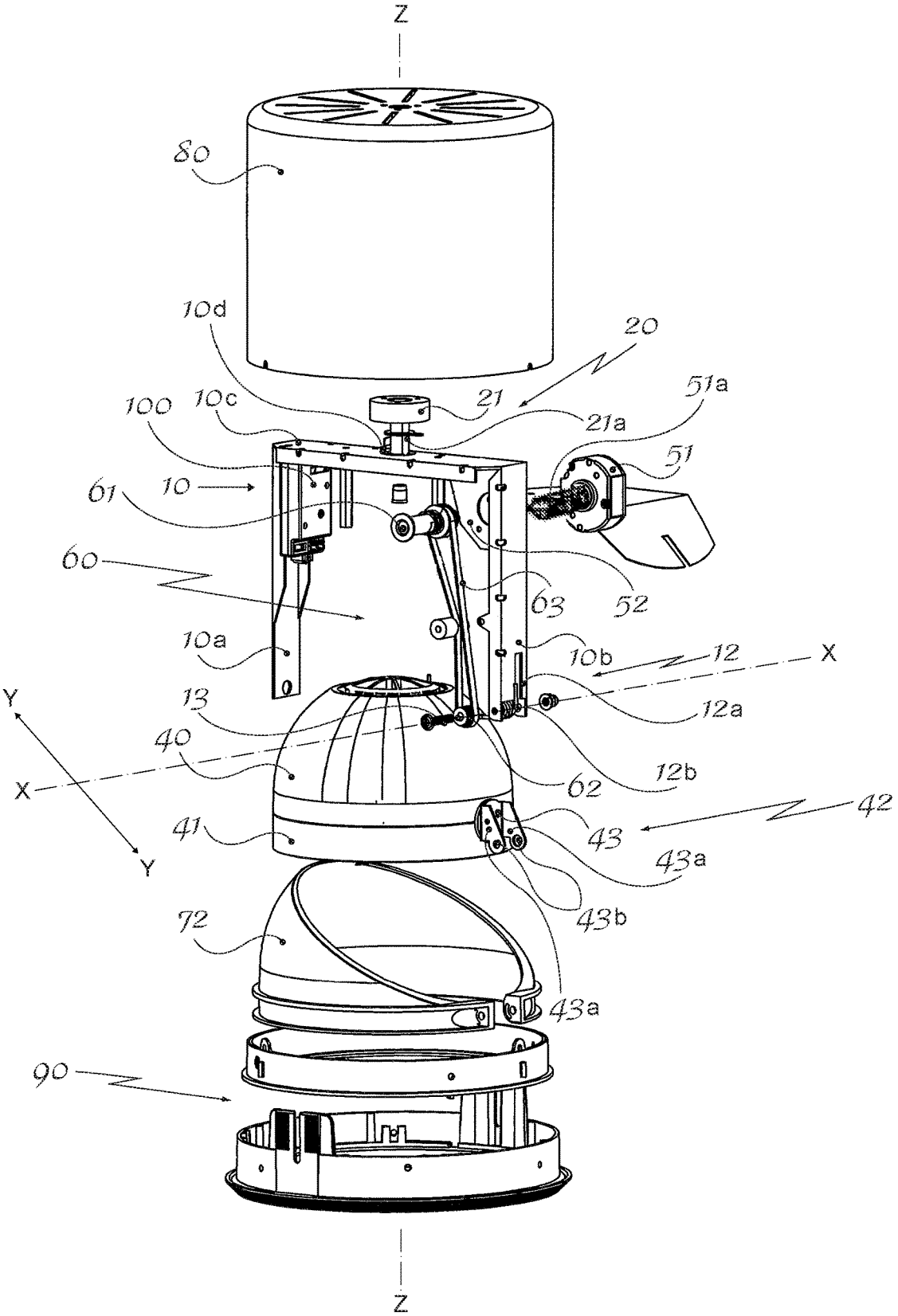
FIG. 2: is an exploded perspective view of a first embodiment of a spotlight according to the present invention.
Figure 3:
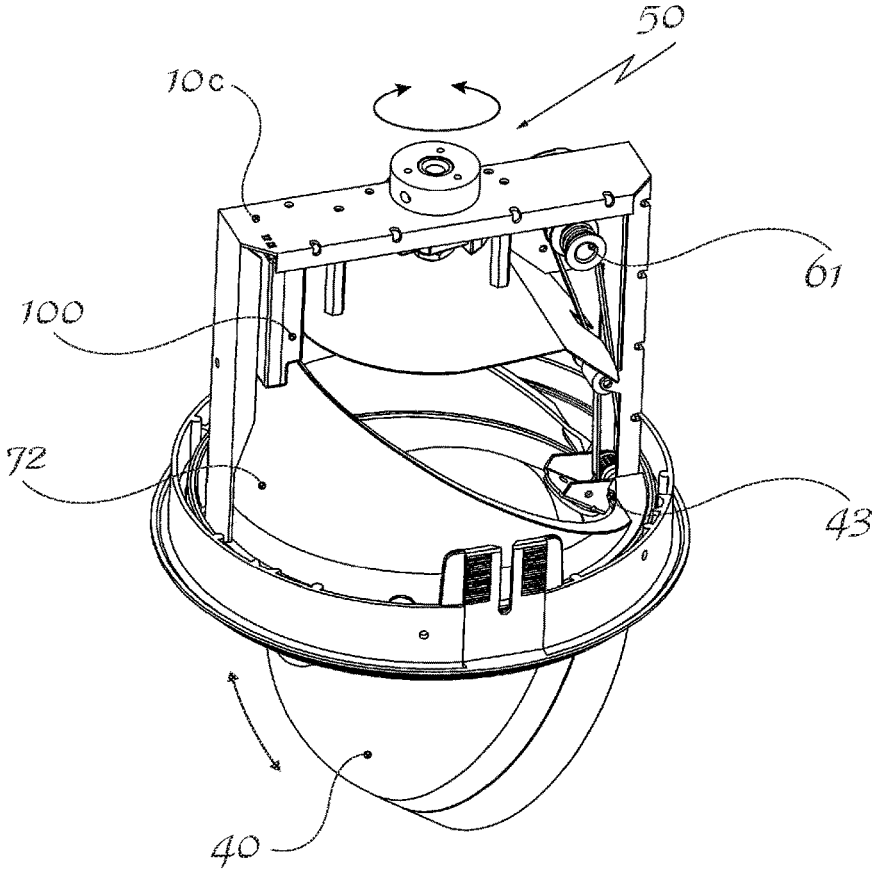
FIG. 3: is a perspective view of the spotlight according to FIG. 2 assembled without the external structure.

As illustrated in FIG. 2, solely for easier description and without a limiting meaning, three axes have been assumed, i.e. in a longitudinal direction X-X, corresponding to the depthwise dimension of the spotlight; in a transverse direction Y-Y corresponding to the width of the spotlight; and in a vertical heightwise direction Z-Z, orthogonal to the other two directions. For easier description and with reference to the orientations shown in the figures, the longitudinal axis X-X is arranged coinciding with a first longitudinal axis of rotation and the axis Z-Z is arranged coinciding with a second vertical axis of rotation.

As shown, a first embodiment of a motorized recessed spotlight according to the invention comprises essentially:

- a frame 10 in the form of a bridge comprising two vertical uprights 10*a*,10*b* connected at the opposite top ends by a longitudinal cross-piece 10*c;*
- the free end of one upright—10*b* in FIG. 2—of the two uprights of the bridge 10 has a fork 12, the opposite arms of which in the longitudinal direction X-X have a respective through-hole 12*b*; said first axis X-X of rotation is defined across the two holes and in the example is shown in the form of a longitudinal pin 13 which, once assembly has been completed, will be locked to the opposite arms 12*a* of the fork 12, as will become clearer below;
- a substantially hemispherical cap 40 which has, mounted inside it in a conventional manner and therefore not described in detail, the means for emission of a light beam, such as lamps, LEDs and the like; along its bottom, outer, annular edge 41 the spherical cap 40 has means 42 which are designed to cooperate with the pin 13 so as to allow rotation of the said cap about the first longitudinal axis of rotation; said means 42 are preferably arranged tangentially on the annular edge 41 of the cap; in the preferred embodiment shown the means 42 comprise a fork-like bracket 43, the arms 43*a* of which have, formed therein, a respective longitudinal-axis hole 43*b* designed to allow insertion of the pin 13;
- devices 50 for rotationally driving the cap 40, comprising:
- a motor 51 fixed to the bridge 10, for example by means of a gusset 52, preferably in a joining zone between upright and cross-piece; The shaft 51*a* of the motor may extend in a substantially longitudinal direction and pass through the gusset with a section of its length such as to allow coaxial engagement with a first pulley 61 of the transmission device 60;
- a device 60 for transmitting the rotational movement of the shaft 51*a* of the motor 51 to the cap 40, preferably comprising said first pulley 61 connected to the motor shaft, and a second pulley 62 which can be coaxially mounted on the pin 13; a belt 63 for transmission of the movement being endlessly wound onto the two pulleys. If required, it is envisaged adding a belt tensioner 63*a* for adjusting the friction to be exerted on the two pulleys.

Figure 4:
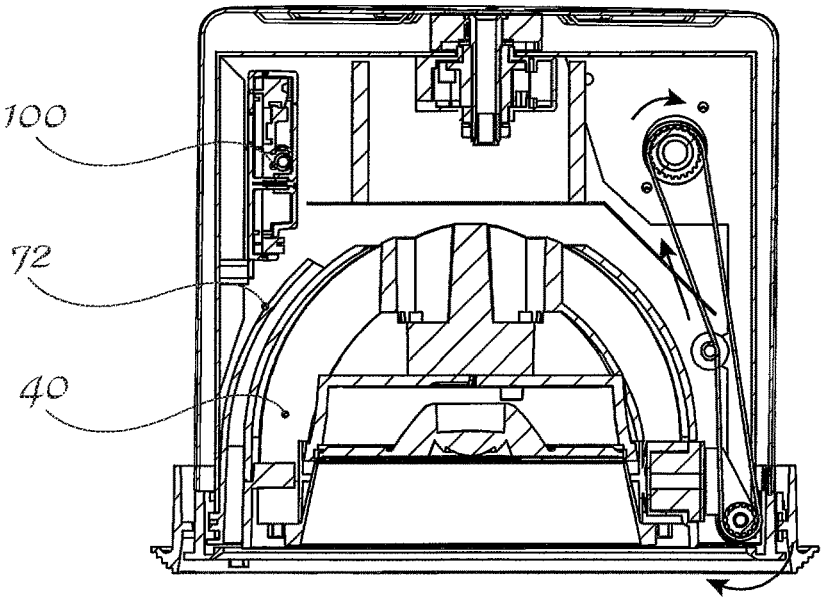
FIG. 4: is a cross-section through the spotlight according to FIG. 2 with the cap rotated inwards.
Figure 4B:
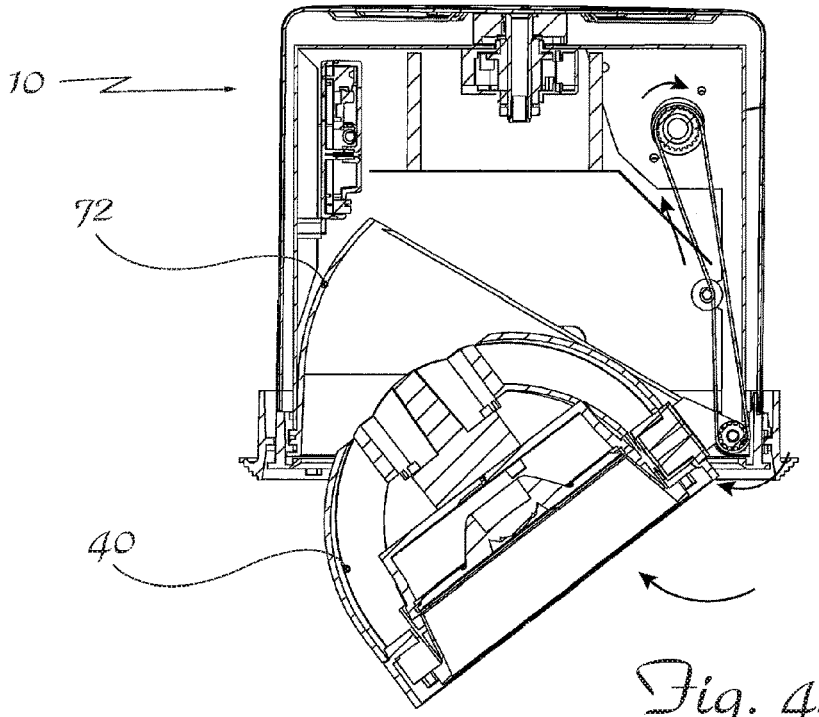
FIG. 4B: is a cross-section through the spotlight according to FIG. 2 during rotation of the cap outwards.
Figure 4C:
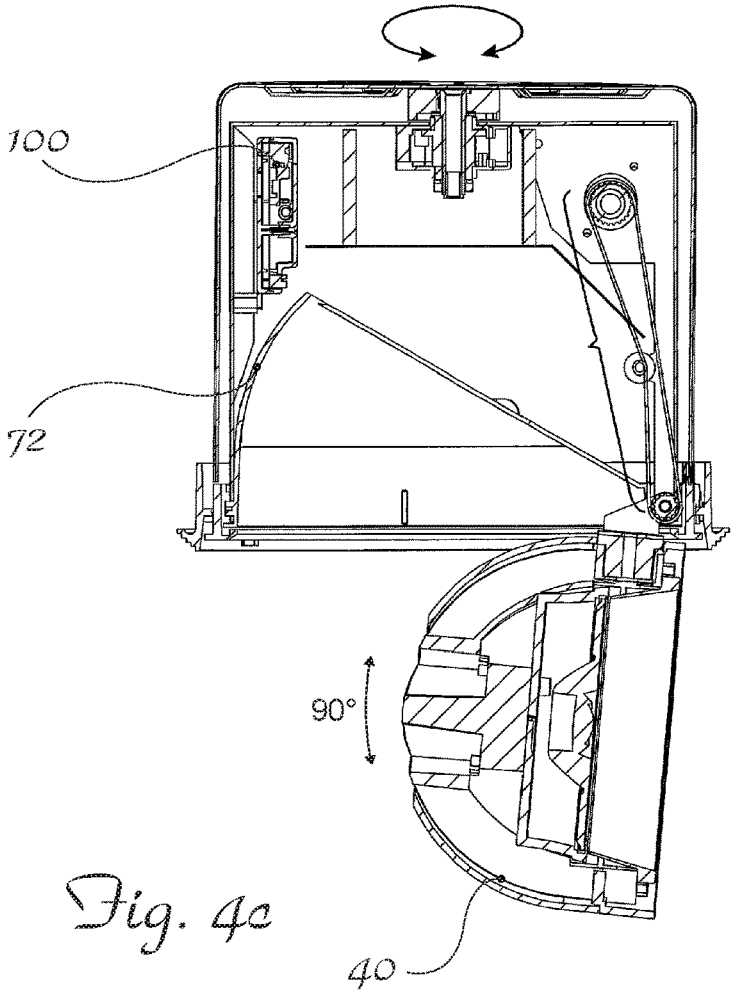
FIG. 4C: is a cross-section through the spotlight according to FIG. 2, 3 with the cap rotated 90° outwards.

With this configuration, once assembly of the spotlight has been completed, with the motor 50 fixed to the bridge 10 and the bracket 42*a* of the cap 40 inserted inside the fork 12 so as to position the respective holes 43*b*, 12*b* coaxially, the pin 13 is inserted through the second pulley 62 and the said holes 12*b*, locking it in position, for example by means of an end nut designed to cooperate with an associated threading on the pin; the belt is connected and suitably tensioned; at this point the spotlight is ready to perform controlled rotational movements of the cap around the first longitudinal axis of rotation X-X so as to adjust it, and therefore the light beam, from a position fully retracted inside the frame 10 (FIG. 4) into intermediate positions partly on the outside of the frame (FIG. 4B); or into a position totally rotated outwards (FIG. 4*c*), corresponding to an angle of rotation about the first axis equal to about 90°, designed to allow the emission of a substantially horizontal light beam which is not intercepted by obstacles forming part of the spotlight, as occurs in the prior art.

According to a preferred embodiment of the spotlight according to the invention it is envisaged that a torsion spring 71 mounted on the pin 13 is arranged between the arms 12*a* of the fork 12 so as to apply a preload which is able to balance the weight of the cap in the various rotated positions.

Preferably, although not shown, it is envisaged that a sliding friction means able to prevent damage to the motor in the event of forced manual manoeuvres is arranged between the shaft 51*a* of the motor 51 for performing rotation about the longitudinal axis X-X and the means for transmission of the movement to the cap 40.

A screen 72 is preferably mounted on the frame 10 and, during use, remains inside the said frame and has a form such as to allow the movement of the cap and at the same time conceal from view the devices for moving the said cap.

The frame 10 may also have, fixed thereto, means 100 of the electronic type which are connected to the motor 50 (and to an additional motor 20, if present) and the light unit 1 which is able to receive radio signals for performing switching on and switching off and/or for controlling rotation from a remote control used by the user, so as to ensure particularly easy and convenient operation of the spotlight which, once installed, normally remains in positions which cannot easily be reached by the user.

Figure 5:
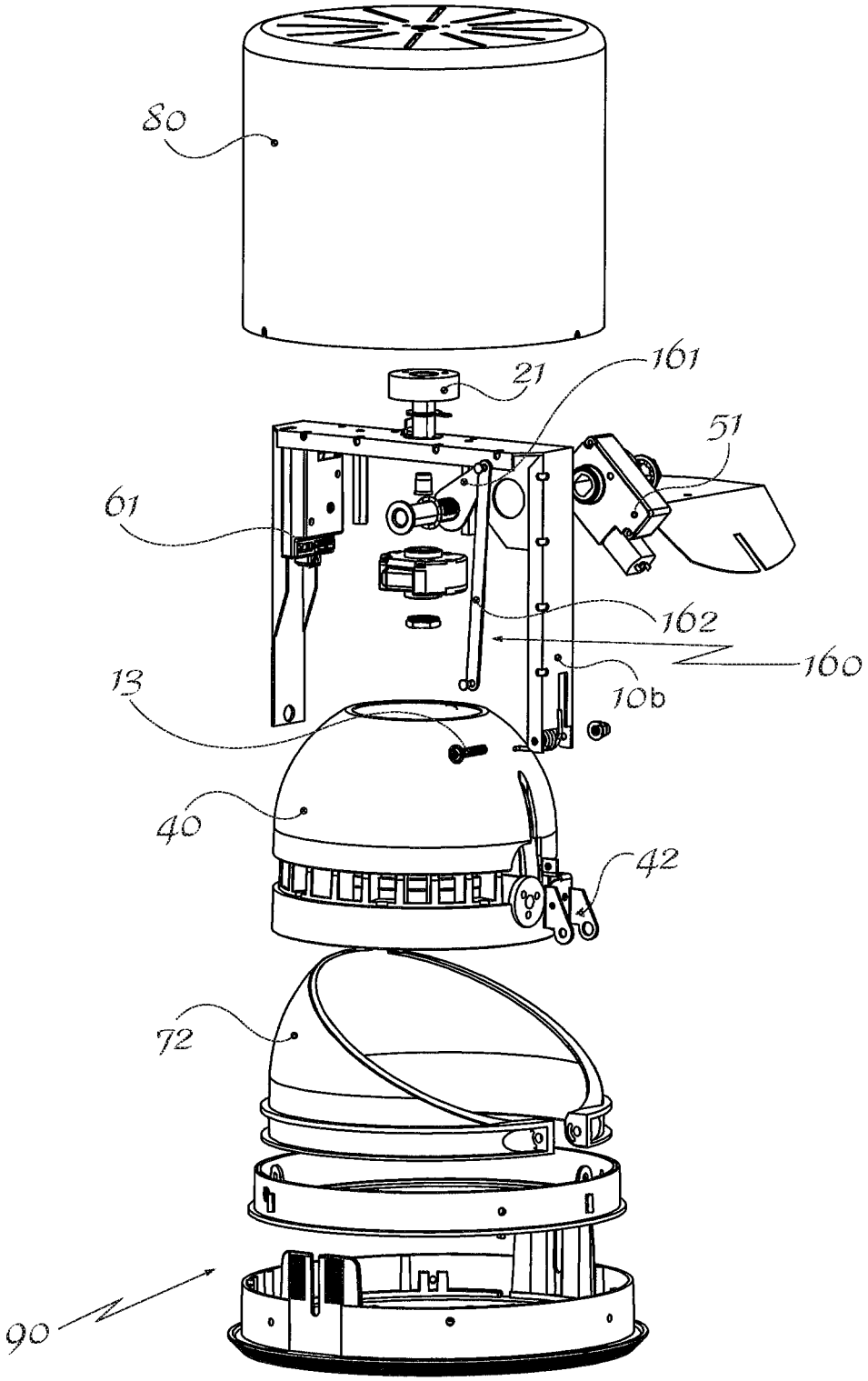
FIG. 5: is an exploded perspective view of a second embodiment of a spotlight according to the present invention.
Figure 6:
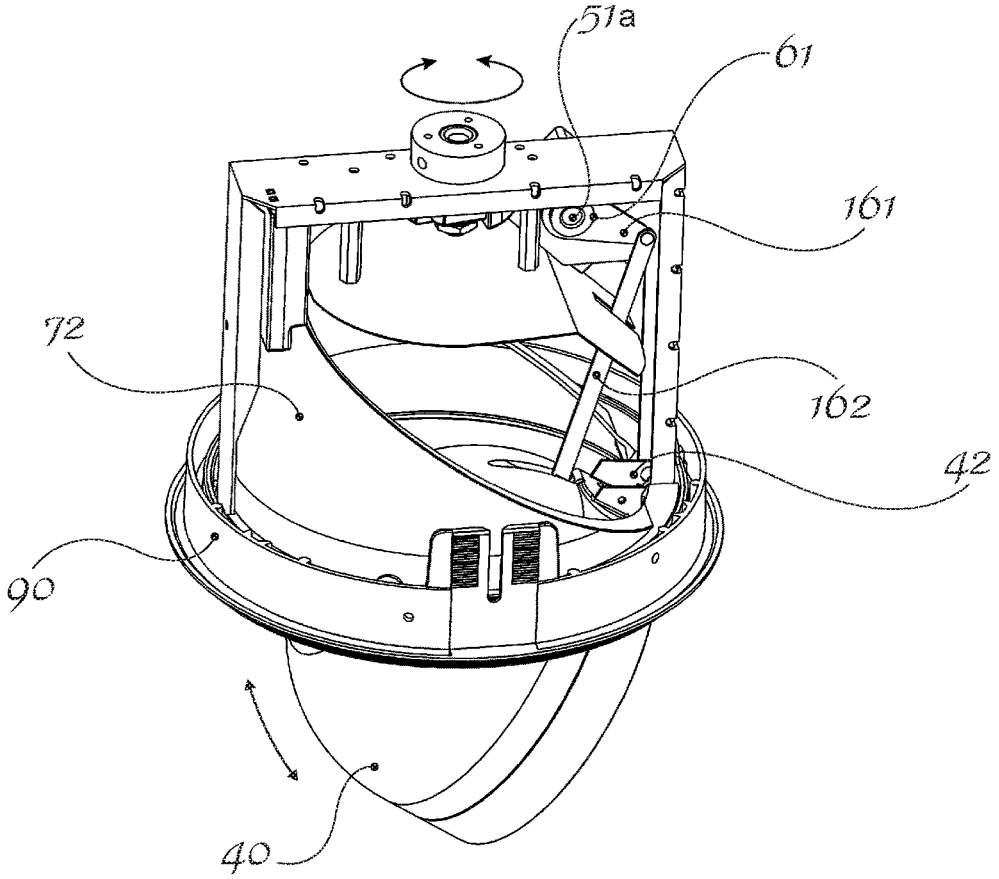
FIG. 6: is a perspective view of the spotlight according to FIG. 5 assembled without the external structure.

FIG. 5 shows a second embodiment of the spotlight according to the invention which is provided with different transmission means 160 for performing rotation of the cap about the first horizontal axis of rotation.

In detail (in the figures the same reference numbers common to all the solutions have been maintained) it is envisaged in this embodiment that:

- the device 160 for transmitting the movement from the motor 50 to the cap 40 comprises a linkage 161, one end of which is mounted on the shaft 51*a* of the motor 50 and the other end of which is pivotably mounted on a first end of a rigid rod 162, the other end of which is pivotably coupled with an arm 143*c* which extends towards the inside of the cap 40 from the bracket 43*a* which is fixed to the annular edge of the said cap 40 on the pin 13 for rotation about the longitudinal axis X-X.

Figure 7A:
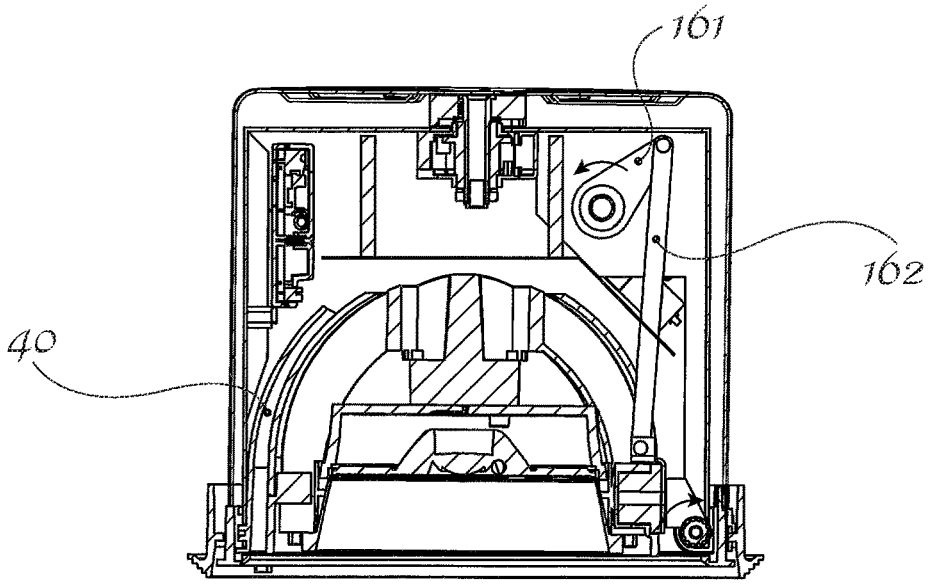
FIG. 7A: is a cross-section through the spotlight according to FIG. 5 with the cap rotated inwards.
Figure 7B:
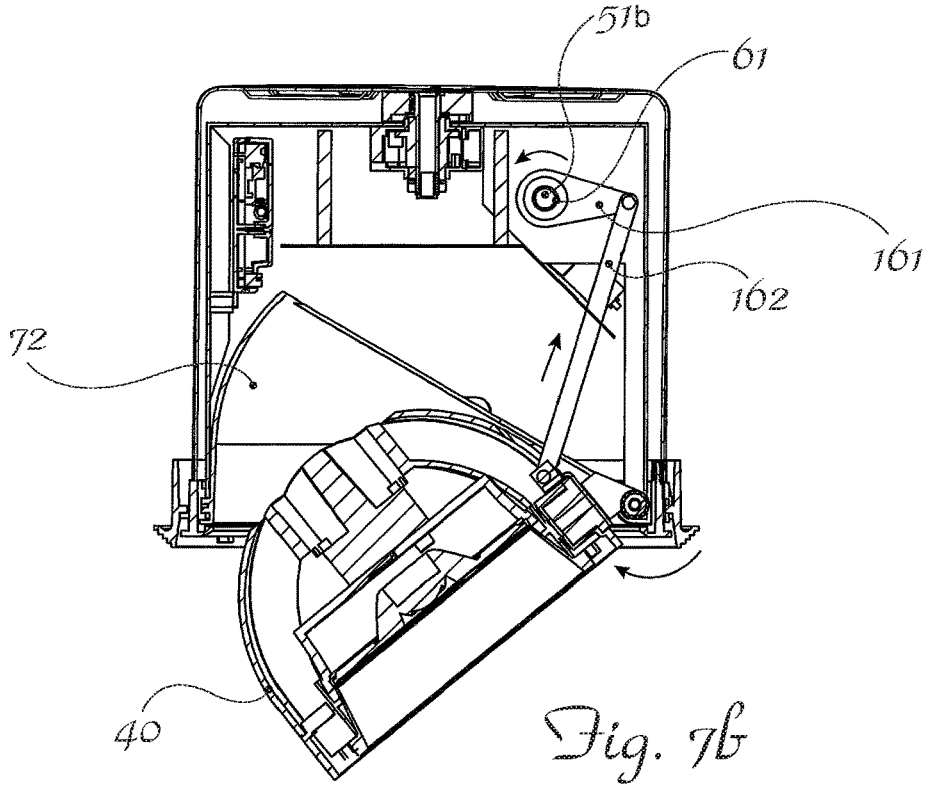
FIG. 7B: is a cross-section through the spotlight according to FIG. 5 with the cap rotated outwards.
Figure 7C:
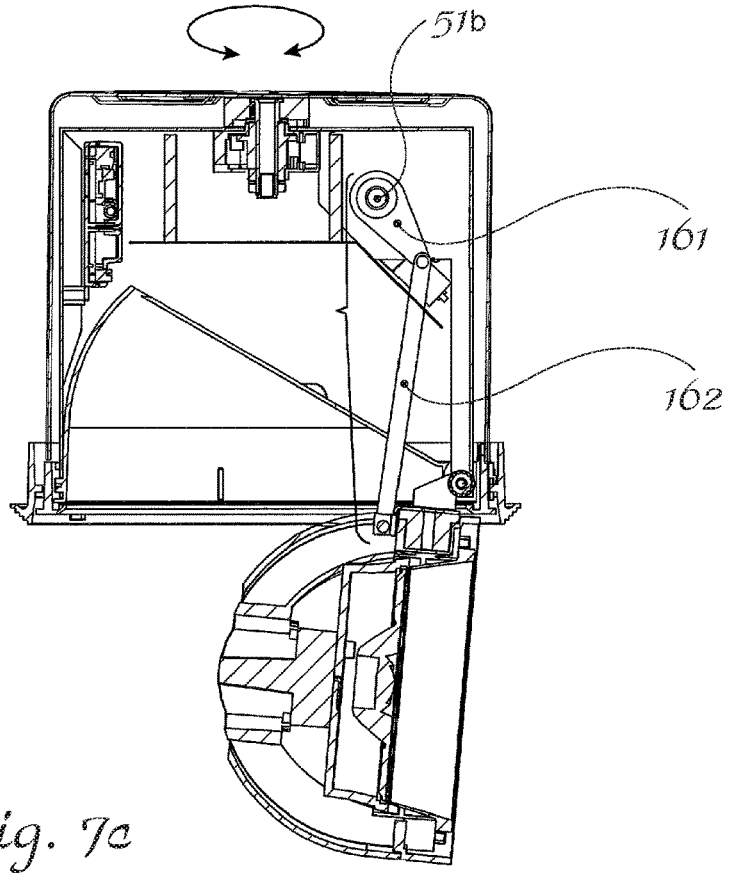
FIG. 7C: is a cross-section through the spotlight according to FIG. 5 with the cap rotated 90° outwards.

As shown in the cross-sections of FIGS. 7*a*-7*c*, the rotations of the linkage 161, actuated by the shaft 51*a* of the motor 51, cause rotary translational movements of the rod 162 such as to bring the hemispherical cap 40 into an internal position, intermediate external position (FIG. 7*b*) and position rotated through 90° outwards (FIG. 7*c*) as in the preceding case.

Figure 8:
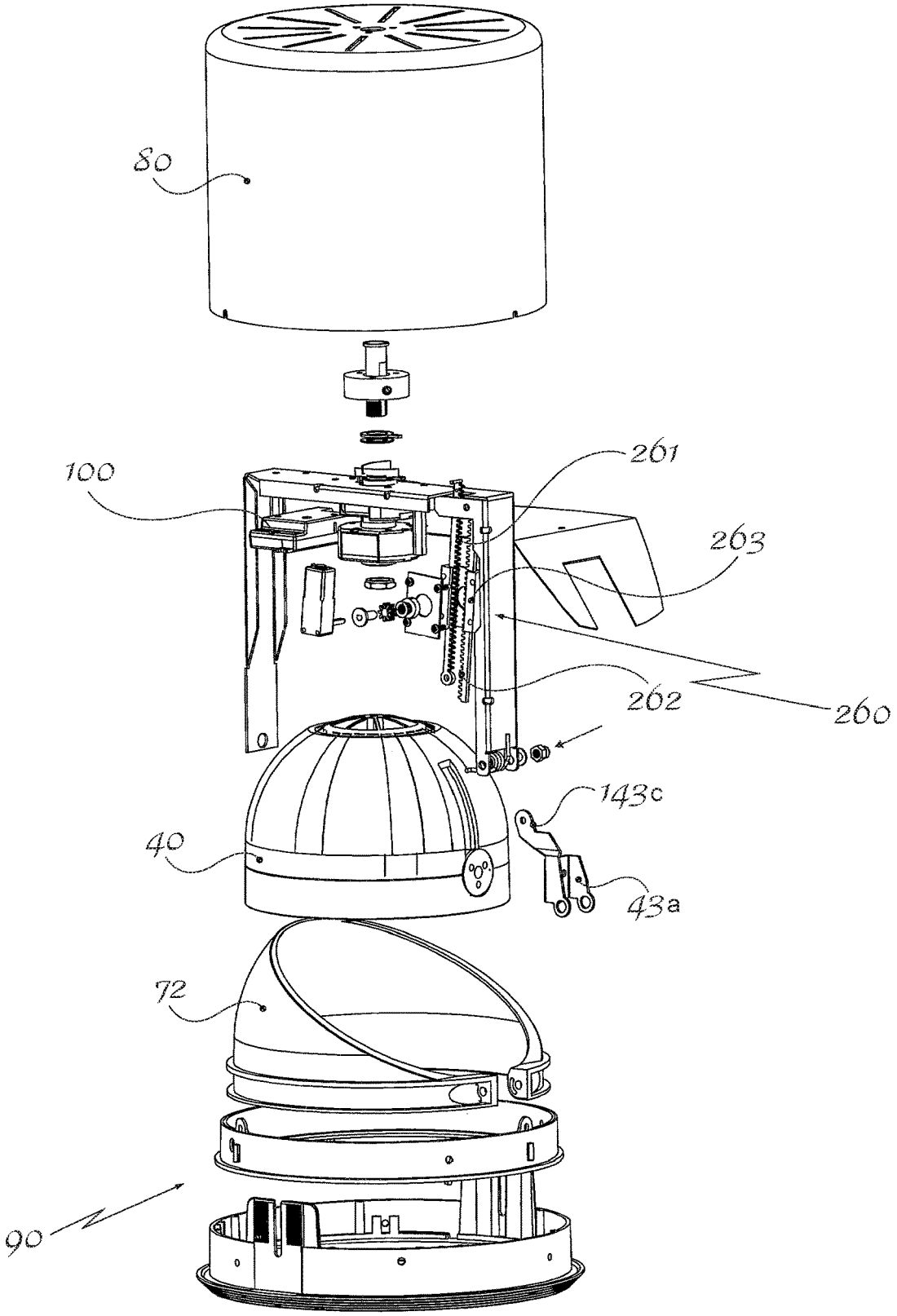
FIG. 8: is an exploded perspective view of a third embodiment of a spotlight according to the present invention.

FIG. 8 shows a third embodiment of the spotlight according to the invention provided with different means 260 for transmitting the rotational movement to the cap.

In detail (in the figures the same reference numbers common to all the solutions have been maintained) it is envisaged in this embodiment that:

- the device 260 for transmitting the movement from the motor 50 to the cap 40 comprises a first rack 261, one end of which is pivotably mounted on the bridge 10 and the other end of which is free, and a second rack 262, opposite to the first rack, a first end of which is pivotably coupled to an arm 143*c* which extends towards the inside of the cap 40 from the bracket 43*a* fixed to the annular edge of the said cap 40, and the other end of which is free.

Figure 9:
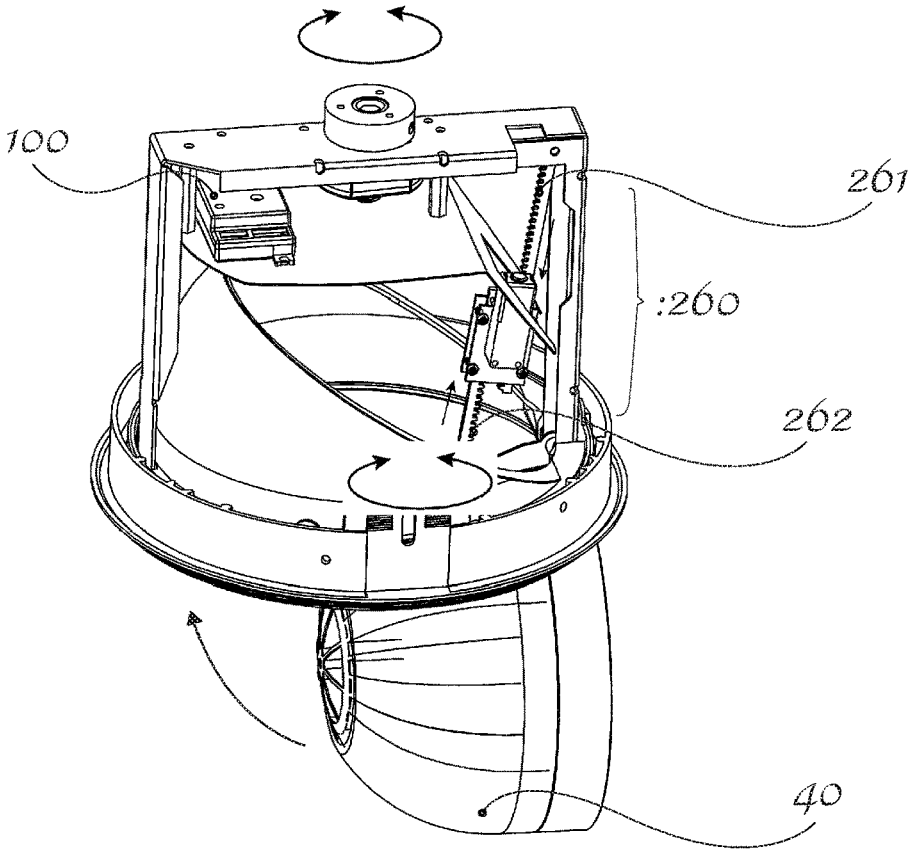
FIG. 9: is a perspective view of the spotlight according to FIG. 8 assembled without the external structure.
Figure 10A:
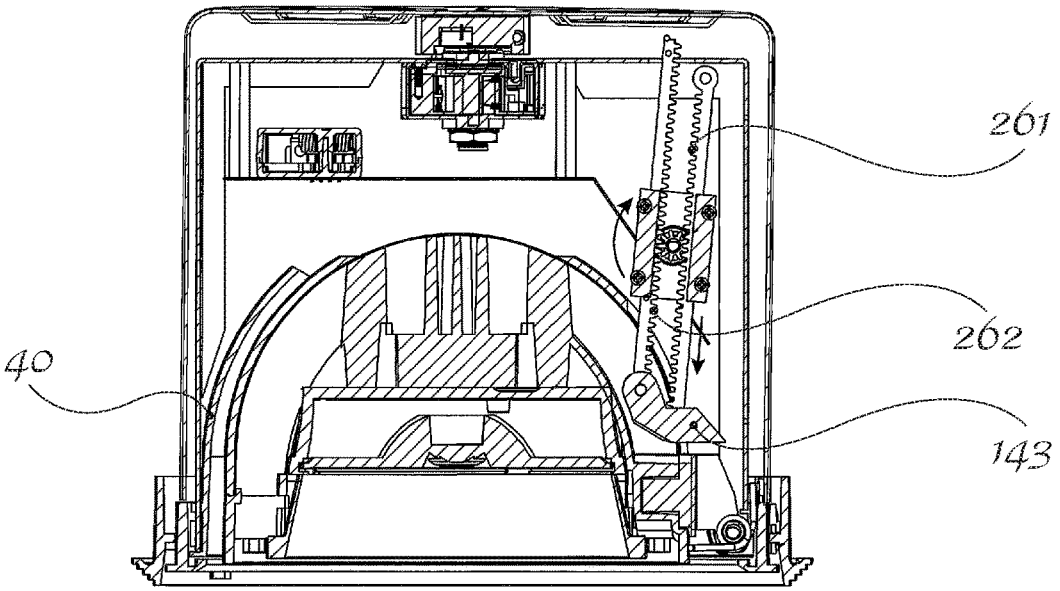
FIG. 10A: is a cross-section through the spotlight according to FIG. 8 with the cap rotated inwards.
Figure 10B:
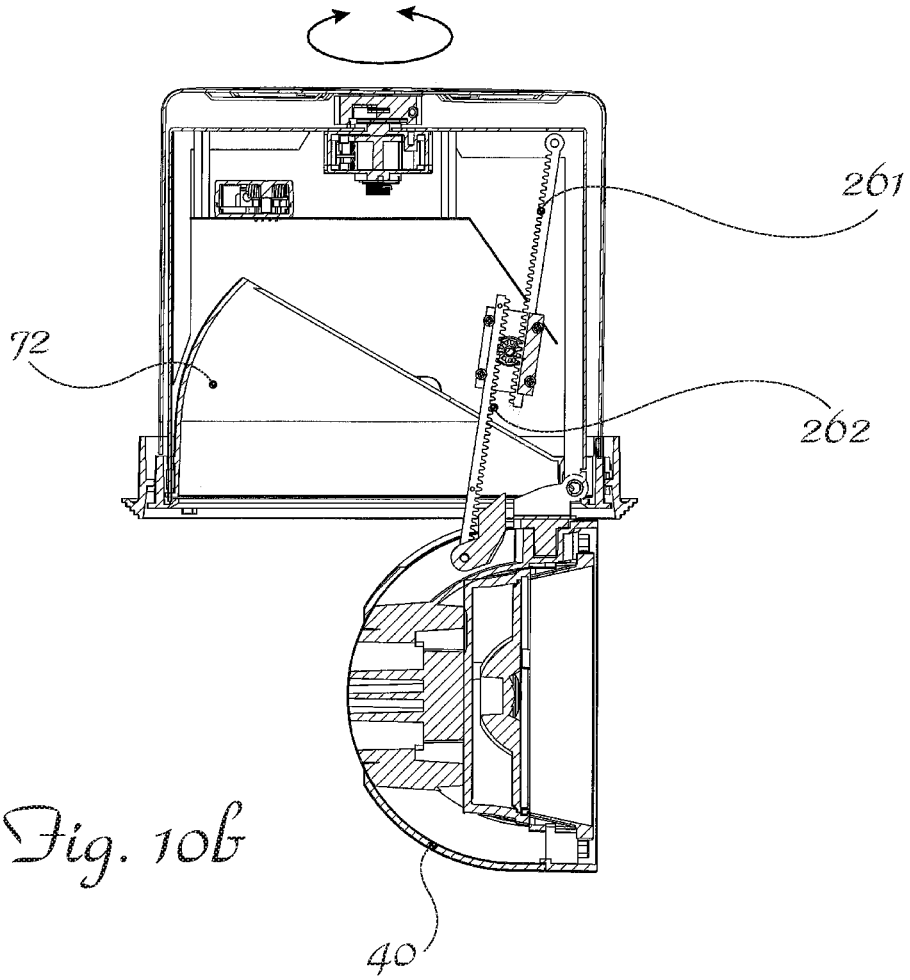
FIG. 10B: is a cross-section through the spotlight according to FIG. 8 with the cap rotated 90° outwards.

The two free ends of the racks are arranged inside a gearing 263 connected to the shaft of the motor 50; in this way the operation of the motor shaft in either direction causes the displacement of the two racks and therefore the outwards/inwards rotation of the cap so that it assumes the different angular positions as described in the above cases and illustrated only for the position rotated 90° outwards in FIG. 9.

Preferably, the spotlight also comprises a top cover 80 which is generally cylindrical and is designed to cover all the parts of the spotlight so as to protect them and allow a combined movement of the spotlight for retraction. As shown, the spotlight may also be assembled together with fixing means 90 which are designed to allow the assembly to be locked in position during recessed-mounting in false ceilings or the like; these means which are per se within the technical knowledge of the person skilled in the art are only shown in the various figures without a detailed description.

Preferably, the spotlight according to the invention has means 20 for rotating the cap 40 about the said second vertical axis Z-Z; in a preferred embodiment said means 20 comprise an electric motor 21, the shaft 21*a* of which is housed inside a through-hole 10*d* passing through the cross-piece 10*c* in a substantially central position.

The motor 21 may also be associated with a sliding friction means arranged between the shaft 21*a* and the frame 10 so as to prevent damage to the motor in the event of forced manual manoeuvres.

Figure 11:
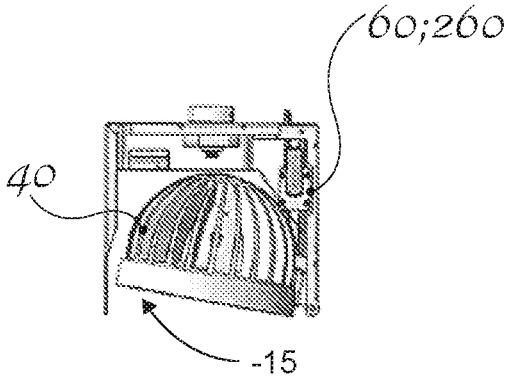
FIG. 11: is a perspective view of the spotlight according to the invention with the cap rotated through an angle of 15° inwards.

As shown in FIG. 11, it is envisaged that the belt means 60 and the rack means 260 for transmitting the movement to the cap 40 may be designed to perform also a negative rotation, i.e. an inwards rotation, for example of up to −15°, this allowing the light beam to be oriented also in a direction opposite to that of normal use with positive rotation through 90°.

Figure 12:
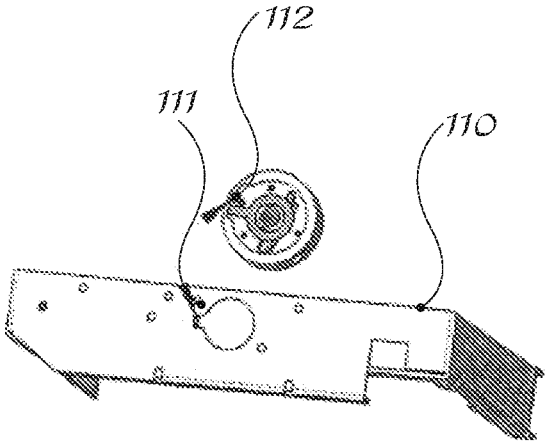
FIG. 12: is a perspective view of a variation of embodiment of the assembly consisting of frame and motor for rotation about an axis Z-Z.

FIG. 12 shows a further embodiment of the frame 110 which has a first stop surface 111 arranged inside the seat for housing the motor 20 which has in turn a second stop surface 112 which is angularly spaced from the first surface in the plane X-Y; the arrangements of the two stop surfaces being designed to allow rotation through 365°, about the vertical axis Z-Z, of the cap 40 which therefore does not result in angle segments which are not covered by the light beam.

It is therefore clear how, with the spotlight according to the invention, it is possible to achieve an orientation of the light beam in vertical directions, inclined at different degrees with respect to the said vertical, as far as a horizontal position which is substantially at 90° with respect to the vertical and where the light beam is still complete, not being intercepted by obstacles forming part of the said spotlight, as occurs in the prior art.

In addition to this the movement systems have a particular form such that they may be housed inside the spotlight, while remaining invisible from the outside and improving the aesthetic appearance of the assembly.

The friction drives ensure a high degree of safety for the spotlight which is not prone to breakages due to inappropriate manual movements.

The fact that the drive may be remotely operated by means of a remote control also makes the assembly particularly easy and convenient to manoeuvre so that the light beam may be moved into the various angled positions as required.

Although described in connection with a number of embodiments and a number of preferred examples of implementation of the invention, it is understood that the scope of protection of the present patent is determined solely by the claims below.

The invention claimed is:

1. A recessed spotlight comprising:

a frame;

a substantially hemispherical cap connected to the frame and arranged to rotate relative thereto about at least one longitudinal axis of rotation of the cap;

means for emitting a light beam, arranged inside and integral with the cap;

at least one device for rotationally driving the cap about the longitudinal axis; and mounting means for mounting the cap, arranged along a bottom, outer, annular edge of the cap and designed to rotate about the longitudinal axis, said mounting means being arranged tangentially to the annular edge of the cap, wherein said frame is a bridge comprising two vertical uprights fixedly connected to opposite ends of a cross-piece, a free end of two free ends of the vertical uprights containing the longitudinal axis of rotation, wherein said at least one device for rotationally driving the cap comprises a motor fixed to the frame, a motor shaft of the motor extending in a direction substantially parallel to the longitudinal axis of rotation and being coaxially connected to a transmission device arranged between the motor shaft and the mounting means.

2. The recessed spotlight according to claim 1, further comprising a pin extending along the longitudinal axis of rotation and designed to cooperate with the mounting means so as to allow rotation of the cap about the longitudinal axis.

3. The recessed spotlight according to claim 1, wherein means for rotating the frame and thereby the cap about a vertical axis of rotation are arranged in a substantially middle position of the cross-piece.

4. The recessed spotlight according to claim 1, wherein the free end of the vertical upright of the bridge which contains the longitudinal axis has a fork, arms of which, opposite each other in the longitudinal direction, have a respective through-hole with an axis parallel to the longitudinal axis of rotation and suitable for inserting a pin.

5. The recessed spotlight according to claim 1, wherein the transmission device comprises a first pulley connected to the motor shaft, a second pulley coaxially mounted on the longitudinal axis of rotation, in particular on a pin; an endless belt for transmitting the movement which is arranged closed on the two pulleys; and optionally a belt tensioner.

6. The recessed spotlight according to claim 1, wherein the transmission device for transmitting the movement from the motor to the cap comprises a linkage, one end of which is mounted on the motor shaft of the motor and the other end of which is pivotably mounted on a first end of a rigid rod, the other end of which is pivotably coupled on an arm which extends towards the inside of the cap from a bracket of the mounting means, which bracket is fixed to the annular edge of the cap on the longitudinal axis of rotation, in particular on a pin which forms the axis of rotation about the longitudinal axis.

7. The recessed spotlight according to claim 1, wherein the transmission device for transmitting the movement from the motor to the cap comprises a first rack, one end of which is pivotably mounted on the frame and the other end of which is free; a second rack which is arranged opposite the first rack and a first end of which is pivotably mounted on an arm which extends towards the inside of the cap from a bracket of the mounting means, which bracket is fixed to the annular edge of the cap, and the other end of which is free, the two free ends of the racks being arranged inside a gearing connected to the motor shaft of the motor.

8. The recessed spotlight according to claim 4, wherein a torsion spring mounted on the axis of rotation, in particular on the pin and designed to apply a preload for balancing the weight of the cap is arranged between the arms of the fork.

9. The recessed spotlight according to claim 1, further comprising means for rotating the frame about a vertical axis of rotation, comprising a motor with a shaft extending parallel to the vertical axis from the frame.

10. The recessed spotlight according to claim 1, further comprising means arranged between a motor shaft and the cap and/or between means for rotation about a vertical axis and the frame.

11. The recessed spotlight according to claim 1, further comprising means of an electronic type for receiving commands from a remote control and for performing rotation of the spotlight about the longitudinal axis and/or about a vertical axis of rotation.

12. The recessed spotlight according to claim 5, wherein the transmission device is arranged to perform rotation of the cap inwards, preferably through an angle of rotation of up to −15°.

13. The recessed spotlight according to claim 9, wherein the frame has a first stop surface arranged inside a seat for housing the motor which has a second stop surface angularly spaced from the first stop surface in a plane.

14. A recessed spotlight comprising:

a frame;

a substantially hemispherical cap connected to the frame and arranged to rotate relative thereto about at least one longitudinal axis of rotation of the cap;

means for emitting a light beam, arranged inside and integral with the cap;

at least one device for rotationally driving the cap about the longitudinal axis;

mounting means for mounting the cap, arranged along a bottom, outer, annular edge of the cap and designed to rotate about the longitudinal axis, the mounting means being arranged tangentially to the annular edge of the cap;

wherein said device for rotationally driving the cap comprises a motor fixed to the frame, the shaft of the motor extending in a direction substantially parallel to the longitudinal axis of rotation and being coaxially connected to a transmission device arranged between the shaft and the mounting means for mounting the cap to transmit rotary movement of the shaft to the mounting means thereby rotating the cap relative to the frame.

15. The recessed spotlight according to claim 14, wherein the transmission device comprises a first pulley connected to the shaft, a second pulley coaxially mounted on the longitudinal axis of rotation, in particular on a pin; an endless belt for transmitting the movement which is arranged closed on the two pulleys; and optionally a belt tensioner.

16. The recessed spotlight according to claim 15, wherein the transmission device for transmitting the movement to the cap is arranged to perform rotation of the cap inwards, preferably through an angle of rotation of up to −15°.

17. The recessed spotlight according to claim 14, wherein the transmission device for transmitting the movement from the motor to the cap comprises a linkage, one end of which is mounted on the shaft of the motor and the other end of which is pivotably mounted on a first end of a rigid rod, the other end of which is pivotably coupled on an arm which extends towards the inside of the cap from a bracket of the mounting means, which bracket is fixed to the annular edge of the cap on the longitudinal axis of rotation, in particular on a pin which forms the axis of rotation about the longitudinal axis.

18. The recessed spotlight according to claim 14, wherein the transmission device for transmitting the movement from the motor to the cap comprises a first rack, one end of which is pivotably mounted on the frame and the other end of which is free; a second rack which is arranged opposite the first rack and a first end of which is pivotably mounted on an arm which extends towards the inside of the cap from a bracket of the mounting means, which bracket is fixed to the annular edge of the cap, and the other end of which is free, the two free ends of the racks being arranged inside a gearing connected to the shaft of the motor.

19. The recessed spotlight according to claim 18, wherein the transmission device for transmitting the movement to the cap is arranged to perform rotation of the cap inwards, preferably through an angle of rotation of up to −15°.

20. A recessed spotlight comprising:

a frame;

a substantially hemispherical cap connected to the frame and arranged to rotate relative thereto about at least one longitudinal axis of rotation of the cap;

means for emitting a light beam, arranged inside and integral with the cap;

at least one device for rotationally driving the cap about the longitudinal axis; and mounting means for mounting the cap, arranged along a bottom, outer, annular edge of the cap and designed to rotate about the longitudinal axis, the mounting means being arranged tangentially to the annular edge of the cap;

wherein said frame is a bridge comprising two vertical uprights fixedly connected to opposite ends of a cross-piece, a free end of two free ends of the vertical uprights containing the longitudinal axis of rotation, and wherein means for rotating the frame and thereby the cap about a vertical axis of rotation are arranged in a substantially middle position of the cross-piece.

21. The recessed spotlight according to claim 20, wherein the frame has a first stop surface arranged inside a seat for housing the motor which has a second stop surface angularly spaced from the first stop surface in a plane.

22. The recessed spotlight according to claim 20, wherein said means for rotating the frame and thereby the cap about the vertical axis of rotation, comprise a motor with a shaft extending parallel to the vertical axis from the frame, arranged above the cap in a vertical direction.

* * * * *